United States Patent [19]

Jones et al.

[11] Patent Number: 4,572,601

[45] Date of Patent: Feb. 25, 1986

[54] PUSH-PUSH BAYONET LAMP SOCKET

[75] Inventors: Jack E. Jones, Greendale; Michael J. Fajner, Bayside; Ronald E. Zepnick, Greenfield, all of Wis.

[73] Assignee: Eaton Corporation, Cleveland, Ohio

[21] Appl. No.: 682,720

[22] Filed: Dec. 17, 1984

[51] Int. Cl.[4] ..... H01R 13/625

[52] U.S. Cl. ..... 339/46; 339/88 R; 339/176 L; 339/181 R; 339/189 L

[58] Field of Search ..... 339/46, 88 R, 91 L, 339/93 L, 176 L, 177 L, 181 R, 181 C, 182 L, 184 L, 185 RL, 187, 188 R, 188 C, 189 L

[56] References Cited

U.S. PATENT DOCUMENTS

| | | | |
|---|---|---|---|
| 3,040,285 | 6/1962 | Stanley | 339/177 L |
| 3,170,751 | 2/1965 | Heller | 339/188 |
| 3,437,775 | 4/1969 | Piber | 200/314 |
| 3,659,249 | 4/1972 | Dupree | 339/88 R |
| 4,112,277 | 9/1978 | Kleeb | 200/153 J |
| 4,161,637 | 7/1979 | Priesemuth | 200/153 J |

*Primary Examiner*—John McQuade

*Attorney, Agent, or Firm*—C. H. Grace; W. A. Autio

[57] ABSTRACT

A push-push lamp socket having a socket member (2) into which a conventional lamp bulb (28) can be mounted by a first axial push and released by a second axial push for removal. In a first version, a cylindrical socket member (2) has four entry recesses (W,N,E,S) or grooves for receiving the radial lugs (24,26) of a conventional lamp bulb in either of two ninety degree orientations (W,E or N,S) and a horizontal groove (4) having slopes (16, 38) leading to pockets (30,40) on its inward and outward sides for latching the bulb lugs (24,26) in response to a first push and disengagement. Additional slopes (42,46) and pocket (44) control the lugs on a second push and disengagement to rotate the bulb lugs into the recesses (N,S) for release from the socket. A second version of lamp socket (50) has a pair of slots (76,78) in its sides, each having a sloping edge (82) and a resilient snap finger (84) providing tactile and audible signals when the bulb (28) follows cam edges or slopes (96 and 100 or 98 and 102) as it is pushed in, and an outwardly sloping track (88) on the finger (84) for guiding the lug (24) under the force of a connector spring (72) into a latch pocket (92). On the second push, an inwardly sloping surface (94) on the finger (84) returns the lug (24) for release of the bulb from the socket. A polarized modification has bulb lugs (112,114) and socket slots (76,120) at different levels for two-filament lamp bulbs.

11 Claims, 8 Drawing Figures

PUSH-PUSH BAYONET LAMP SOCKET

BACKGROUND OF THE INVENTION

Bayonet lamp sockets have been known heretofore. A bayonet connection is defined as a device in which the two parts are retained in coupled relationship by pins or projections which extend radially of the coupling engaging axis, the pins being received behind a circumferentially extending abutment in the mating socket part, the engaging motion being first along the coupling axis and then a partial turning about the coupling axis. In bayonet lamp sockets of this type, it has been necessary to manually grip the bulb, locate the slot, push it down into the socket and then turn it a partial turn and release it so that the radial pins engage behind the abutments within the socket and are held therein by a bias spring within the bottom of the socket. Push-push mechanisms have also been known heretofore. For example, E. T. Piber U.S. Pat. No. 3,437,775, dated April 8, 1969, shows a pushbutton switch having a push-push latching mechanism that includes three radial lugs or pins on a movable member and a stationary cylindrical latching liner within the switch that latch the pushbutton down on the first push and release it on the second push. As the pushbutton is depressed, the central portion that carries the radial lugs is forced downwardly until the lugs engage respective cam surfaces on the liner, causing the lug carrying member to rotate. When the pushbutton is released, a bias spring moves the central portion and the lugs carried thereby axially into a catch to latch the pushbutton in the depressed position. When the pushbutton is depressed a second time, the three lugs move downwardly to engage a second set of cams or ridges, respectively, to cause the lug carrying member to rotate further into its release position. When the pushbutton is then released, the bias spring restores the pushbutton axially to its undepressed position.

While the aforementioned bayonet lamp socket has been useful for its intended purpose, it has nevertheless been handicapped by the fact that it has not been generally applicable to a small lamp bulb or the like which cannot be securely gripped by the fingers in its insertion and rotation when mounting the same in a socket. Also, such bayonet lamp sockets have not been generally applicable to structures wherein the lamp bulb, upon being mounted, enters substantially entirely within the shroud or upper walls of the socket because the fingers cannot enter therein to grip the bulb for rotation and removal. Moreover, such bayonet socket lamp bulbs have also been subject to overforce in manual rotation, causing the glass portion of the lamp bulb to break or become loosened from its base thereby damaging the same.

SUMMARY OF THE INVENTION

This invention relates to a push-push bayonet lamp socket of the type wherein the lamp bulb enters entirely or almost entirely within the upper walls or shoud of the socket and can be mounted by dropping or inserting the lamp bulb in the socket and depressing it once with the tip of the finger or with a small tool such as a pencil and then releasing it to allow it to latch in position under the force of a bias spring below the base of the bulb and which can be removed from the socket by depressing the bulb a second time and releasing it whereupon the bias spring lifts the bulb sufficiently to enable manual removal of it from the socket.

An object of the invention is to provide an improved lamp socket of the push-push bayonet type.

A more specific object of the invention is to provide an improved lamp socket that enables mounting of a lamp bulb therein by merely momentarily pushing the same.

Another specific object of the invention is to provide an improved lamp socket that enables removal of the lamp bulb by merely momentarily pushing and releasing it.

Another specific object of the invention is to provide an improved push-push bayonet lamp socket that accepts the lamp bulb in either of two positions 90 degrees apart and does not require particular orientation of the bulb for assembly of the same in the socket.

Another specific object of the invention is to provide an improved push-push bayonet lamp socket that enables mounting of the bulb by a push and release motion wherein there is insufficient room for manual gripping of the bulb.

Another specific object of the invention is to provide a push-push bayonet lamp socket of the polarized type.

Other objects and advantages of the invention will hereinafter appear.

DESCRIPTION OF THE PREFERRED EMBODIMENTS

Figure 1:
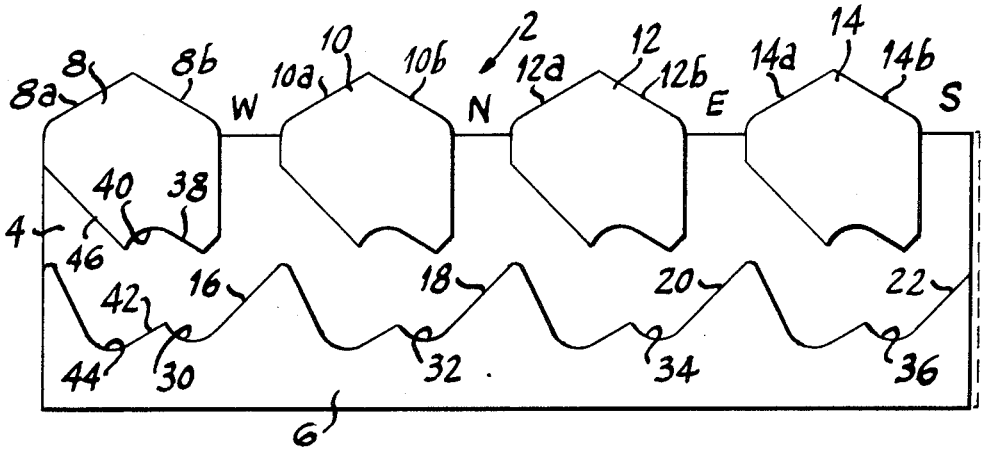
FIG. 1 is an enlarged flat elevational view of the inside surface of the socket member of a push-push bayonet lamp socket constructed in accordance with the invention.
Figure 2:
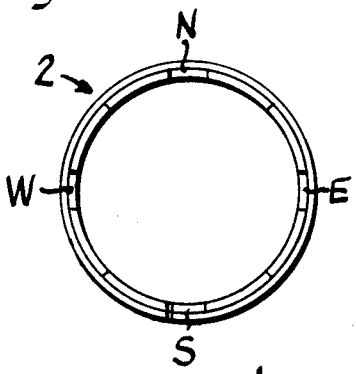
FIG. 2 is a reduced-scale top view of the flat socket member of FIG. 1 rolled into a cylindrical form.
Figure 3:
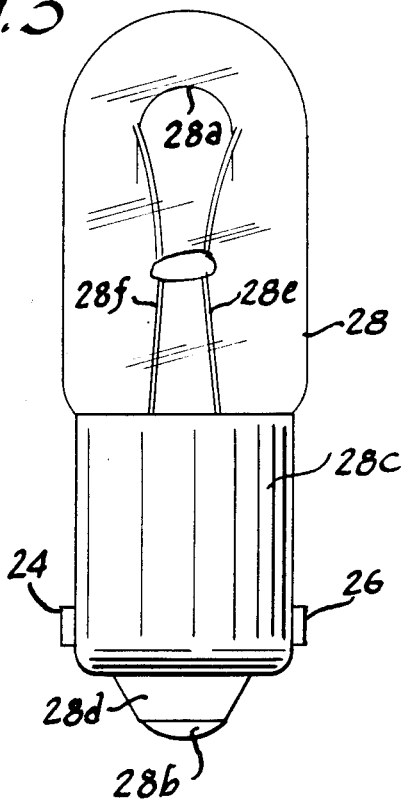
FIG. 3 is an elevational view of an enlarged lamp bulb of the non-polarized single-filament type.

Referring to FIGS. 1–3, there is shown a first version of the invention. As shown in FIGS. 1 and 2, the lamp socket is made by forming a socket member 2 from a flat piece as shown in FIG. 1 and then rolling it into cylindrical form as shown in FIG. 2 to receive the lamp bulb of FIG. 3. As shown in FIG. 1, socket member 2 is made by forming a four branch groove therein including a generally zig-zag horizontal groove 4 having four unitary vertical branch recesses or grooves W, N, E and S extending upwardly therefrom in spaced relation to one another. This four branch groove is defined by a lower raised horizontal portion 6 and four identical upper raised portions 8, 10, 12 and 14 with double-inclined upper edges 8*a–b*, 10*a–b*, 12*a–b* and 14*a–b* and equally spaced from one another by vertical branch grooves W, N, E and S. Therefore, when this socket member 2 is rolled into cylindrical form as shown in FIG. 2, grooves N and S will be diametrically opposite one another and grooves W and E will be diametrically opposite one another. Lower horizontal raised portion 6 is provided with four angular cam edges or inward slopes 16, 18, 20 and 22 for engagement by the lugs or pins 24 and 26 of lamp bulb 28 shown in FIG. 3 when the lamp bulb is pressed into the socket. The lower ends of cams 16, 18, 20 and 22 are provided with respective lower pockets or stops 30, 32, 34 and 36 for receiving lugs 24 and 26 to stop the inward movement and rotation of the bulb upon depression thereof. In a similar manner, each upper raised portion such as 8 of latch member 2 is provided with an angular cam edge or outward slope 38 directly above pocket 30 for receiving the corresponding lug of the lamp bulb after it is released and it moves upwardly by bias spring force for rotating the lamp bulb further and leading the corresponding lug into upper stop or pocket 40 wherein the lamp bulb is latched. Lower raised portion 6 of the socket member is provided with four second angular cam edges or inward slopes such as 42 directly below and spaced from each pocket 40 for engagement by the lug of the lamp bulb when the lamp bulb is depressed a second time in its release motion thereby causing further rotation of the lamp bulb lug into a recess or pocket such as 44 which limits such further inward motion and rotation of the lamp bulb. Riased upper portions 8, 10, 12 and 14 of socket member 2 are each provided with a second angular cam edge or outward slope 46 directly above pocket 44 for engagement by the lug of the lamp bulb upon release thereof to cause further rotation of the lamp bulb so that the lugs thereof enter vertical grooves S and N thereby to cause the lamp bulb to pop out of the socket under the force of the bias spring. While such bias spring is not shown in FIGS. 1–2, it will be similar to that shown and hereinafter described in connection with FIG. 4 or 8.

From the foregoing, it will be apparent that when lamp bulb 28 shown in FIG. 3 is mounted in the lamp socket, it can be oriented in either of two directions 90 degrees apart so that lugs 24 and 26 of the lamp bulb enter either grooves N and S or W and E. Assuming that lug 24 enters groove W, upon the first push, lug 24 will slide down inclined cam 16 and stop in recess 30. Upon the lamp bulb being released, lug 24 will be pushed upwardly by the bias spring to engage inclined cam 38 and slide therealong into recess 40 thereby to latch the lamp bulb in the socket. At the same time, lug 26 will enter groove E and become latched in a similar manner. When it is desired to remove the lamp bulb, it is pushed a second time and released. This causes lug 24 to move down from recess 40 and slide down inclined cam 42 into recess 44 where it stops. Upon the lamp bulb being released, the bias spring will move lug 24 along with the bulb directly upwardly and engage inclined cam 46 and slide therealong into vertical groove S whereupon the lamp bulb is free to be removed from the socket.

From the foregoing, it will be apparent that lamp bulb 28 shown in FIG. 3 is of the non-polarized type. This means that it has only a single illuminator or filament 28*a* to be lighted when electrical voltage is applied to a single central terminal 28*b* with the return electrical path being through the metal base 28*c* and metal lugs 24 and 26, both the base and the lugs being of electrically conductive material and terminal 28*b* being insulated therefrom by insulator material 28*d*. In this type of bulb, filament 28*a* is connected at one end through a connector 28*e* to terminal 28*b* and is connected at its other end through connector 28*f* to base 28*c* so that when a voltage is applied across terminal 28*b* and base 28*c*, filament 28*a* is lighted.

Figure 4:
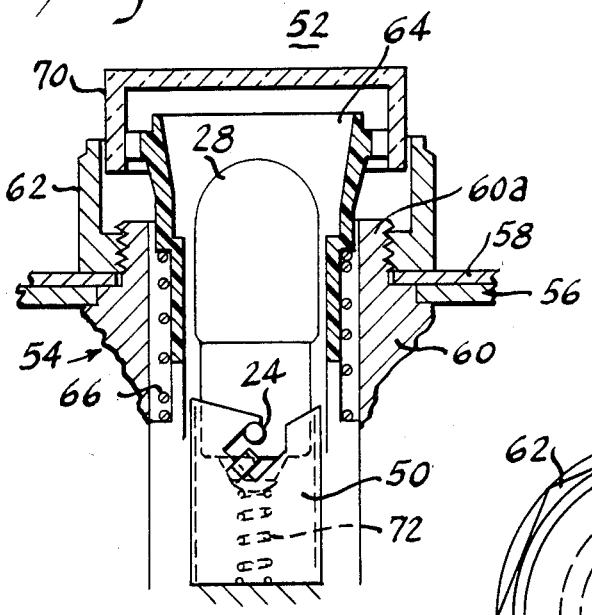
FIG. 4 is an enlarged partial cross-sectional view of a modified push-push bayonet lamp socket within an indicating light or pushbutton constructed in accordance with the invention.
Figure 5:
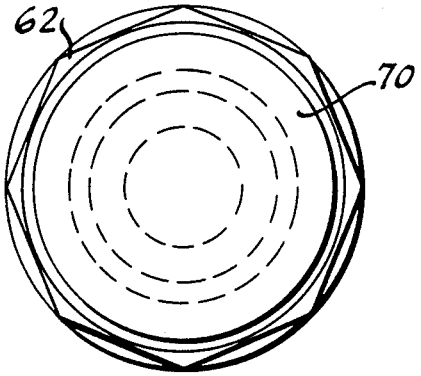
FIG. 5 is a top view of the indicating light or pushbutton of FIG. 4.

Referring to FIG. 4, there is shown a modification of the lamp socket of FIG. 1. As shown therein, the lamp socket 50 is mounted within the pushbutton 52 of a pushbutton switch 54 or the like which is supported on a mounting panel 56, there being an escutcheon plate 58, seal, washer or the like overlying the mounting panel around the pushbutton switch. The upper externally threaded end 60*a* of the pushbutton or indicating light housing 60 is inserted up through the hole in the mounting panel, escutcheon plate 58 is placed therearound against the mounting panel and lock nut 62 is threaded onto housing 60 to rigidly mount the pushbutton or indicating light to the panel. In this manner, mounting plate 56 and escutcheon plate 58 are clamped between switch housing 60 and lock nut 62. The pushbutton or indicating light switch also includes a shroud or reflector 64 which is biased upwardly a limited extent by a helical compression spring 66 as generally shown in FIG. 4. Lamp socket 50 is mounted within and to a stationary part of the pushbutton for retaining a removable lamp bulb 28. A lense 70 is secured to the upper end of reflector 64 which serves also as the plunger for the pushbutton, lense 70 covering lamp bulb 68 so as to defuse the light emanating therefrom. A small diameter helical compression spring 72 is mounted in the bottom portion of lamp socket 50 for biasing lamp bulb 68 upwardly and also serving as an electrical connector from the lower center terminal of the lamp bulb to an electrical circuit while the return electrical connection from the lamp bulb base is through socket 50. FIG. 5 shows a top view of lense 70 and lock nut 62.

Figure 7:
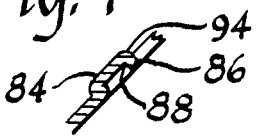
FIG. 7 is a fragmentary cross-sectional view taken along line 7—7 of FIG. 6 to show the cross section of the resilient "click" member which causes rotation of the bulb upon being mounted or released.
Figure 6:
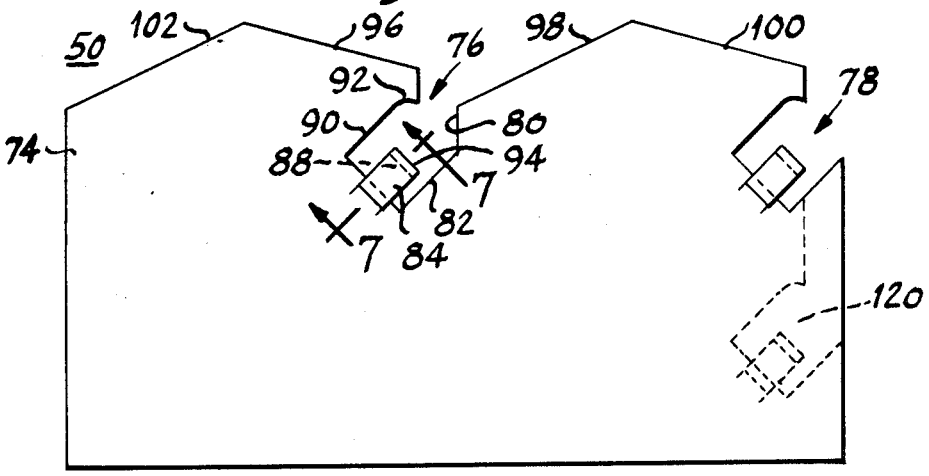
FIG. 6 is a larger scale flat elevational view of the socket member of the lamp socket of FIG. 4.

Lamp socket 50 of FIG. 4 is formed from a flat metal sheet member 74 shown in FIG. 6 and then rolled into cylindrical form to provide the lamp bulb socket as shown in FIG. 4. This metal sheet member 74 is provided with a pair of catches or slots 76 and 78 for the respective lugs 24 and 26 of lamp bulb 28. Each such catch or slot such as 76 is provided with a vertical slot or recess 80 through which lug 24 of the lamp bulb may be inserted downwardly into the slot to engage an inwardly inclined edge 82 which causes rotation of the bulb as it is depressed into the slot. Part-way down this inclined edge 82, lug 24 engages a beveled-end resilient finger 84 which provides a tactile effect and an audible click sound as the lug snaps below the beveled and inwardly bent end 86, FIG. 7, of finger 84. Upon release of the lamp bulb, lug 24 thereof is pushed by compression spring 72 upwardly along the outwardly inclined inner surface 88 of tip 86 of finger 84 for further rotation in the same direction. When lug 24 leaves the upper end of surface 88, it is free to move freely upwardly within the catch to engage upper outwardly inclined edge 90 along which it slides into pocket 92 to be latched therein. In this manner, the lamp bulb is securely mounted within the socket by a first push resulting in an audible and tactile signal and disengagement of the bulb to be securely retained therein. To release the bulb from the socket, only a shorter second push is required without causing any click followed by release of the bulb to allow bias spring 72 to pop it out of the socket with lug 24 moving upwardly through vertical slot 80. During this release push, lug 24 moves downwardly from pocket 92 and engages the upper surface of inwardly bent tip 94 of finger 84 and slides therealong to rotate the bulb away from alignment with pocket 92 and into alignment with vertical slot 80 whereupon disengagement of the bulb allows spring 72 to pop it out of the socket with lug 24 passing upwardly through vertical slot 80. Catch 78 is similar to catch 76 and cooperates with the other lug 26 of the lamp bulb in a similar manner as hereinbefore described. The upper edge of sheet metal member 74 is formed with a pair of double inclines 96, 98 and 100, 102 leading down toward slots 76 and 78, respectively, to facilitate entry of lugs 24 and 26 of the lamp bulb into the slots as the bulb is dropped or inserted into the socket.

Figure 8:
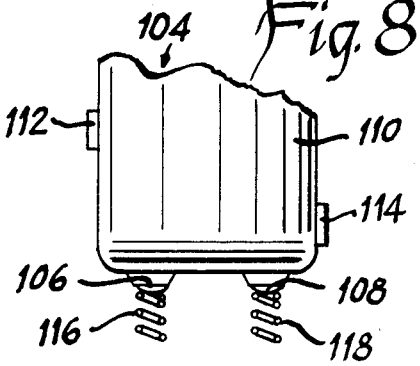
FIG. 8 an enlarged fragmentary view of a portion of the base of a polarized lamp bulb that is designed for cooperation with the broken line modification of FIG. 6.

FIG. 6 also shows in broken lines a modification of the invention providing a polarized push-push lamp socket for use with the double filament lamp shown partially in FIG. 8. As shown in FIG. 8, lamp bulb 104 is of the type having two filaments where two different levels of light are required, as for example, the different levels of light used for parking and brakes in automobiles. For this purpose, lamp bulb 104 in FIG. 8 is provided with a pair of insulated contacts 106 and 108 at the bottom thereof for leading electrical power to the two filaments, respectively, with the common return path for the electrical circuit being through base 110 as well as lugs 112 and 114. When this lamp bulb 104 is used, two helical compression spring terminals 116 and 118 are preferably provided within the lamp socket to provide not only the spring bias to the bulb but also electrical connection from contacts 106 and 108 of the bulb to an electrical circuit. It will be apparent from FIG. 8, that lamp bulb 104 must always be properly oriented within the socket when it is mounted therein so that contact 106 will engage terminal 116 and contact 108 will engage terminal 118 so as to apply the proper voltages to the two filaments of the bulb. For this purpose, lugs 112 and 114 are provided at different levels on base 110 as shown in FIG. 8.

For this modification of polarized lamp socket, sheet metal member 74 in FIG. 6 would be provided with slot 76 as previously described for lug 112 and another slot 120 at a lower level corresponding to the level of lug 114 as shown in broken lines for lug 114 of the lamp bulb. For this modification, the lamp bulb 104 must always be properly oriented so that lug 112 enters slot 76 and lug 114 enters slot 120 before the bulb is pushed into place. Except for the fact that slot 78 would not be included in this modification, otherwise this polarized lamp socket functions in a similar manner when used with polarized lamp bulb 104 as hereinbefore described.

From the foregoing, it will be apparent that this push-push lamp socket facilitates the mounting of the lamp bulb therein particularly with respect to small lamp bulbs which are difficult to grip with the fingers for depression and rotation or where the shroud or reflector such as 64 in FIG. 4 completely surrounds the upper portion of the lamp bulb so that the user cannot get his fingers therein to grip the bulb for removal. Also, this invention prevents the possibility of damaging or breaking lamp bulbs by twisting the glass loose from the base as has often been the case particularly with the smaller bulbs in depressing and manually turning such bulbs, sometimes with excessive force, in the prior art bayonet sockets. The modification shown in FIGS. 6 and 7 has the advantage that it provides both tactile and audible sensation to the user to indicate that the bulb has properly entered the socket for retention therein.

While the apparatus hereinbefore described is effectively adapted to fulfill the objects stated, it is to be understood that the invention is not intended to be confined to the particular preferred embodiments of pushpush bayonet lamp socket disclosed, inasmuch as they are susceptible of various modifications without departing from the scope of the appended claims.

We claim:

1. A push-push lamp socket for a lamp bulb of the type having a base mounting a glass bulb enclosed illuminator with electric contact means on said base and radial mounting lugs on said base for securing said bulb in said socket, said lamp socket comprising:

a hollow socket member for receiving said lamp base and comprising:

recesses in the walls of said socket member for receiving said radial lugs as said base is inserted axially thereinto;

spring-biased connector means within said socket member for engaging said contact means;

and push-push latch means communicating with said recesses comprising:

latch means responsive to a first axial push of said lamp bulb into said socket against the bias of said connector means followed by disengagement thereof for securing said lamp bulb by said lugs in a latched position and concurrently engaging said contact means to said connector means in said socket;

and release means responsive to a second axial push of said lamp bulb inwardly of said latched position against the bias of said connector means followed by disengagement thereof for releasing said lugs from said latched position for removal of said lamp bulb.

2. The push-push lamp socket claimed in claim 1, wherein:

said recesses in the walls of said socket member comprise two recesses diametrically opposite one another for receiving the two diametrically opposite lugs of a conventional lamp bulb;

and said hollow socket member comprises double-slope edges leading from points between and above said recesses down to said recesses for guiding said lugs into said recesses when said bulb is pushed axially at any rotational angle.

3. The push push lamp socket claimed in claim 1, wherein:

said recesses in the walls of said socket member comprise two pairs of angularly disposed recesses with the recesses of each pair thereof being diametrically opposite one another to receive the two diametrically opposite lugs of a conventional lamp bulb in either pair of said recesses.

4. The push-push lamp socket claimed in claim 3, wherein:

said hollow socket member comprises double-slope edges between the entrances to adjacent recesses allowing insertion of said lamp bulb in any rotational orientation whereby said lugs slide along said slope edges into said recesses when said bulb is pushed axially into said socket.

5. The push-push lamp socket claimed in claim 1, wherein:

said lamp bulb is a single filament bulb wherein said radial mounting lugs are at the same level;

and said recesses are at the same level in the walls of said socket member for receiving said lugs of said single filament bulb.

6. The push-push lamp socket claimed in claim 1, wherein:

said lamp bulb is a double filament polarized bulb wherein said radial mounting lugs are at different levels;

said recesses are at correspondingly different levels in the walls of said socket member for receiving the respective lugs of said polarized bulb;

said contact means comprises a pair of insulated contacts on said lamp bulb base;

and said spring-biased connector means comprises a pair of spring-biased connectors insulated from one another and mounted in said socket so as to engage the correct lamp bulb contacts when said lugs are in said latched position.

7. The push-push lamp socket claimed in claim 1, wherein:

said latch means comprises:

a groove in the inner wall of said socket member having directly inwardly of each said recess an inward slope terminating in a stop pocket along which slope the corresponding bulb lug slides when said bulb in pushed until it reaches said pocket and stops;

and said groove having directly outwardly of each said stop pocket an outward slope terminating in a latch pocket along which outward slope said corresponding bulb lug slides under the force of said spring-biased connector means following said disengagement of said bulb until it stops in said latch pocket.

8. The push-push lamp socket claimed in claim 7, wherein:

said release means comprises:

as a part of said groove directly inwardly of each said latch pocket an inward release slope terminating in another stop pocket along which inward release slope said corresponding bulb lug slides when said bulb is pushed a second time until it reaches said other stop pocket and stops;

and said groove having directly outwardly of each said other stop pocket an outward release slope terminating in the corresponding recess along which said corresponding bulb lug slides under the force of said spring-biased connector means following said disengagement of said bulb after said second push until it reaches said recess for removal of said bulb.

9. The push-push lamp socket claimed in claim 1, wherein:

said latch means comprises:

slots in the wall of said socket member communicating with the respective recesses and each having directly inwardly of said recess an inwardly sloped edge terminating in a stop along which sloped edge the corresponding bulb lug slides when said bulb is pushed until it reaches said stop;

a resilient finger partially overlying the path of movement of said lug down said sloped edge causing said resilient finger to provide a tactile and audible signal indicative of the progress of said lug into latching position;

said finger having directly outwardly of said stop an outwardly sloped track along which said lug slides under the force of said spring-biased connector means following said disengagement of said bulb to offset said lug from said recess;

and a catch in said slot directly outwardly of the outward end of said track in which said lug stops in its latched position.

10. The push-push lamp socket claimed in claim 9, wherein:

said release means comprises:

an inward release slope on the top of said finger directly inwardly of said catch along which said bulb lug slides into alignment with said recess in response to a second push of said lamp bulb so that disengagement thereof allows said spring-biased connector to move said bulb lug into said recess for free removal of the bulb.

11. The push-push lamp socket claimed in claim 1, wherein:

said lamp socket also comprises:

a shroud or reflector extending outwardly of said socket member and closely surrounding said lamp bulb which prevents gripping of the lamp bulb with the fingers but allows mounting thereof in said socket and release thereof by axial push motions.

* * * * *